United States Patent [19]

Hoffman

[11] 4,047,856

[45] Sept. 13, 1977

[54] ROTARY STEAM ENGINE

[76] Inventor: Ralph M. Hoffman, 15950 N. Hillcrest Court, Eden Prairie, Minn. 55343

[21] Appl. No.: 668,150

[22] Filed: Mar. 18, 1976

[51] Int. Cl.[2] ..... F01C 1/02; F01C 21/12

[52] U.S. Cl. ..... 418/61 A; 418/183

[58] Field of Search ..... 418/61A, 183, 187, 188

[56] References Cited

U.S. PATENT DOCUMENTS

| | | | |
|---|---|---|---|
| 3,112,870 | 12/1963 | Bentele | 418/61 A |
| 3,319,612 | 5/1967 | Hamada | 418/61 A |
| 3,373,722 | 3/1968 | Zimmermann et al. | 418/183 X |
| 3,456,623 | 7/1969 | Weigert et al. | 418/61 A X |
| 3,561,894 | 2/1971 | King | 418/61 A X |
| 3,881,847 | 5/1975 | Chen | 418/61 A |
| 3,883,273 | 5/1975 | King | 418/61 A |
| 3,891,357 | 6/1975 | Davis et al. | 418/61 A |

*Primary Examiner*—Carlton R. Croyle
*Assistant Examiner*—Leonard Smith
*Attorney, Agent, or Firm*—Merchant, Gould, Smith, Edell, Welter & Schmidt

[57] ABSTRACT

A unidirectional rotary expansion steam power unit which is free from external valving arrangements and independent starting mechanisms, and which is adapted for multiple use in a system selectively using direct energization and compounding of the units. The power fluid is supplied through a hollow rotor, and is conducted to working chambers and exhausted therefrom by strategically located passages in the walls of a housing, under the control of seal means carried by the rotor.

11 Claims, 7 Drawing Figures

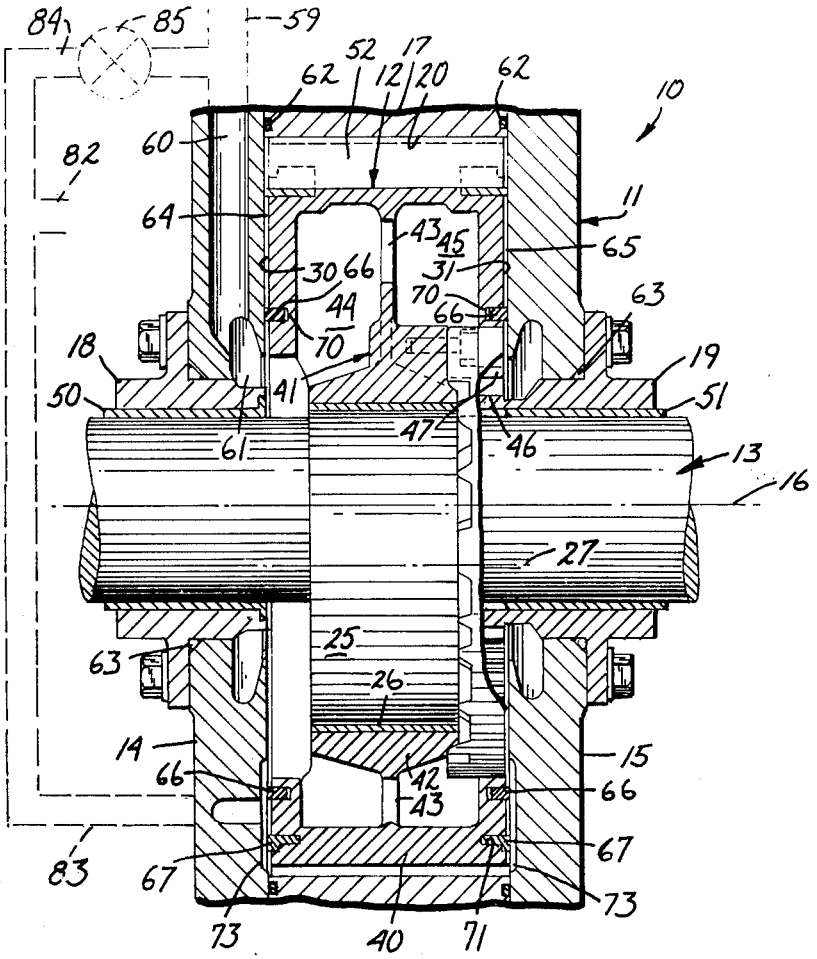
FIG. 2
FIG. 1
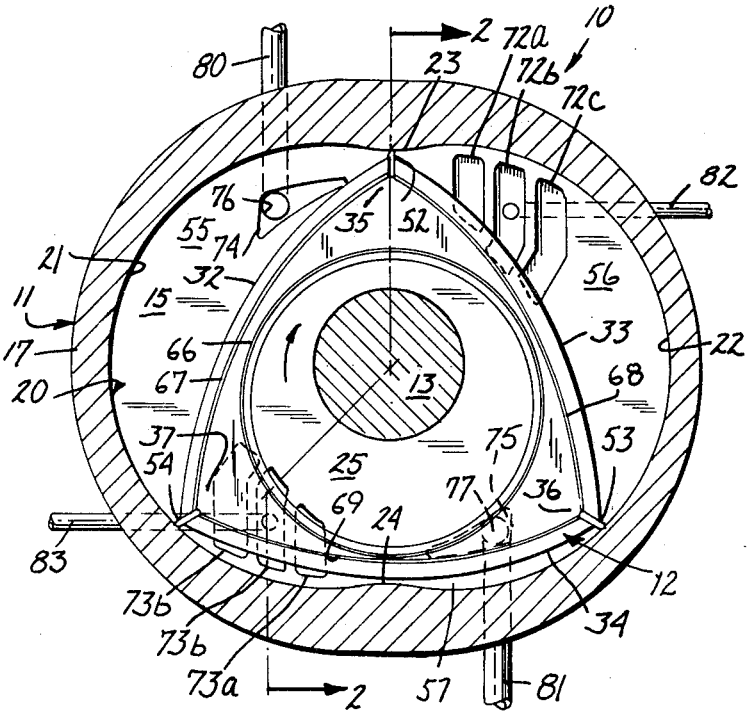

ROTARY STEAM ENGINE

BACKGROUND OF THE INVENTION

This invention relates to unidirectional rotary expansion steam power units of the type having a planetating rotor, and more particularly to an improvement in means for effecting rotation of the rotor in such engines.

In rotary expansion steam engines of the Wankel type, the flow of pressure fluid into the working chambers is controlled by valves external to the engine cavity, the action of which valves is synchronized with the rotor motion through the crankshaft and gear trains or like systems. Such engines are known as variable cutoff or variable displacement engines because the amount of steam admitted, and hence the expansion thereof, may be varied by altering the time during which the inlet valves are open. This necessity for external valves and mechanisms for timing their operation results in an expansion engine of relatively great complexity, bulkiness, and cost. Therefore, expansion engines of the Wankel type have not heretofore been competitive with sliding vane type expansion engines, in spite of the greater capability and efficiency of the Wankel type engines.

SUMMARY OF THE INVENTION

This invention comprises an expansion power unit having a planetating rotor which requires no external valves and timing mechanisms and hence is relatively small in size, simple in construction, and inexpensive to operate. The planetating rotor itself functions in cooperation with passages in the housing walls to control the timing and duration of the flow of pressure fluid to and from working chambers. An added valuable feature of the invention is the fact that it is adapted for starting without the use of a separately powered external starting system, and for operation always in a single direction. The units are also well adapted for either direct or compound energization with the power fluid.

Internal combustion single rotor engines produce intermittent torque, and, depending or port design, may produce a negative torque during a portion of one single rotation, thus requiring a flywheel and operation with minimum rotational speeds of approximately 500 rpm. Because my single rotor engine delivers uninterrupted torque moments, it is capable of slow speed operation and does not require a flywheel as does a Wankel type internal combustion engine.

To achieve these benefits, I provide a housing having opposed end walls spaced by a peripheral wall to define a multi-lobed cavity in which a hollow rotor is constrained to perform what I define as planetation movement, that is, revolution about a first axis combined with rotation about a second axis which remains parallel to the first axis, the speed of rotation having a known relation to the speed of revolution. The rotor has side wall surfaces which intersect at apices to determine lines of sealing contact with the peripheral wall of the housing which define a plurality of planetating working chambers. The chambers successively increase and decrease in volume as they follow the movement of the rotor. The side wall surfaces of the rotor are in apposition and in slightly spaced relation to the end walls of the housing, and carry seal means for preventing the escape of pressure fluid continuously supplied to the hollow rotor. On at least one side wall surface the seal means includes inner, valving seal means extending around the rotor, and outer, working chamber isolation seal means. At least the adjacent end wall of the housing is provided with passage means effective to conduct power fluid past the seal means to the working chambers during first portions of the rotor movement, and to provide egress for said fluid from said working chambers during second portions of the rotor movement.

A feature of the invention is that the passage means in the housing end wall can be so located as to prevent power fluid from being supplied to any working chamber prematurely to the extent of creating an undesirable negative torque, a defect usually found in fixed-displacement or fixed-cutoff engines lacking external valves and valve gear. As a result my engine may be designed to provide positive and uninterrupted torque at any speed above zero rpm.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing,

FIG. 1 is a view of a power unit according to my invention seen axially, with an end wall removed for clarity of illustration;

FIG. 2 is an enlarged sectional view of the power unit, taken generally along the line 2—2 of FIG. 1 and showing the rotor in a "dead-center" position;

DESCRIPTION OF THE PREFERRED EMBODIMENT

Figure 4:
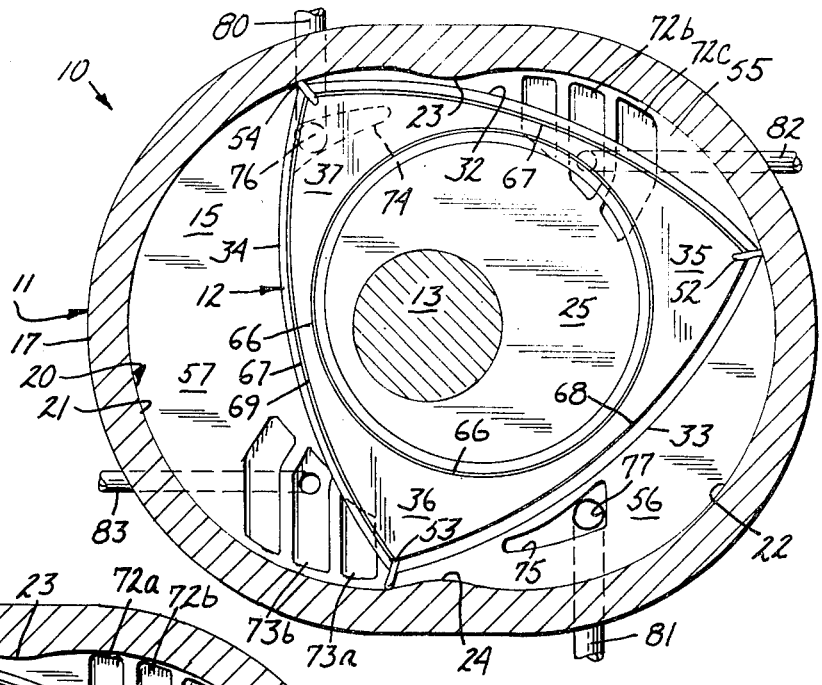
FIG. 3, 4 and 5 are views like FIG. 2 showing the rotor in other positions.

As shown in FIGS. 1-5, a power unit according to my invention comprises a housing 11, a rotor 12, and a crankshaft 13. Housing 11 comprises a pair of opposite end walls 14 and 15, spaced apart along the axis 16 of crankshaft 13 by a peripheral wall 17 shaped to define a cavity 20 symmetrical about axis 16 and having a pair of epitrochoidal lobes 21 and 22 which intersect at lobe junctures 23 and 24 which define the minor axis of the housing. Crankshaft 13 is mounted in bearing inserts 18 and 19 in end plates 14 and 15, and includes an eccentric 25 which is itself circular in traverse section to engage a hollow circular bearing 26 in rotor 12. The rotor is symmetrical about the axis 27 of bearing 26 and eccentric 25 and hence is radially displaced from axis 16 by an eccentricity *e*. It comprises a pair of opposite side wall surfaces 30 and 31, adjacent and in slightly spaced relation to housing end walls 14 and 15, and interconnected by a plurality of smooth epitrochoidal flank surfaces 32, 33, and 34 which intersect at apices 35, 36 and 37. The rotor includes a rim 40 of varying thickness, a web 41, and a hub 42 containing bearing 26. Web 41 is provided with a plurality of paraxial apertures 43. Rotor 12 is referred to as hollow to define apertures 43 and the spaces 44 and 45 inward from rim 40 on each side of web 41 which function on a plenum space. An external gear 46 is fixed to bearing insert 19 concentric with axis 16 and hence with crankshaft 13, and an internal gear 47 is fixed in rotor 12 concentric to axis 27 to mesh with gear 46.

For the structure shown, where housing 11 has two lobes and rotor 12 has three apices, the tooth ratio between gear 47 and gear 46 is 3:2. It will be appreciated that epitrochoidal cavities of more lobes can be used, with rotors of more apices, and that the gear ratio will change accordingly. Crankshaft 13 is mounted for rotation in bearings 50 and 51 carried by inserts 18 and 19, respectively.

Eccentric 25 and gears 46 and 47 combine to limit the movement of rotor 13 in housing 11 to a combination of rotation about axis 27 and revolution about axis 16, which I have defined as planetating movement. Apices 35, 36 and 37 define the location of lines of sealing contact between the rotor and the housing, and may be provided with suitable seal blades 52, 53 and 54. Rotor flanks 32, 33 and 34 and housing lobes 21 and 22 combine to define a plurality of working chambers 55, 56 and 57, which move about axis 16 with movement of flank surfaces 32, 33, and 34 respectively of the rotor, decreasing and increasing in volume cyclically as they do so.

Pressure fluid is supplied to the hollow rotor from a source such as a steam boiler, not shown, through a conduit 59 and an inlet connection 60 to an annular channel 61 in wall 14, and it is intended to be supplied to working chambers 55, 56, and 57 at appropriate times to act on the rotor flanks 32, 33 and 34 respectively so as to cause rotor planetation in a generally clockwise direction as seen in FIG. 1. To this end, O-rings 62 or other suitable means are provided between wall 17 and walls 14 and 15, respectively, and similar O-rings 63 are provided to seal inserts 18 and 19 to housing walls 14 and 15. Side wall surfaces 30 and 31 are also provided with seal means to control the flow of pressure fluid in the interstices 64 and 65 between them and housing end walls 14 and 15, all respectively. These seal means comprise valving seal means and working chamber isolation seal means respectively. The former comprises sealing rings 66 of sealing material received in circular grooves 70 in the rotor side wall surfaces. The latter comprises sealing members 67, 68 and 69 received in grooves 71 in the side wall faces and suitably sealed at their ends to blades 52, 53 and 54.

Figure 5:
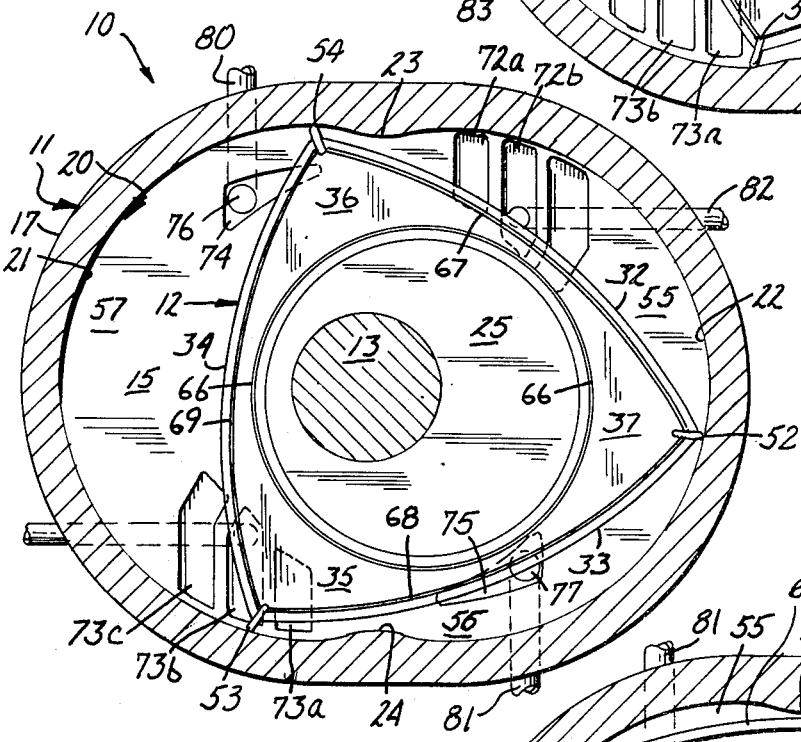
Figure 3:
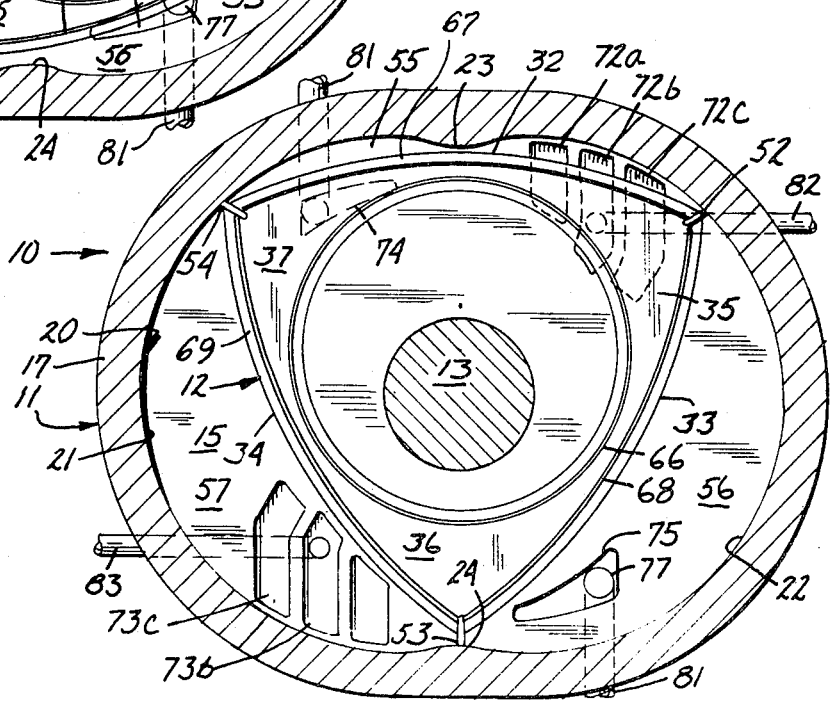

In the inner surface of wall 15, in the area of lobe 22 near lobe junction 23 (FIG. 1), there is provided first passage means comprising a plurality of grooves **72*a*, 72*b*, 72*c* extending generally radially from axis 16, and for a double acting engine similar grooves 73*a*, 73*b* and 73*c*, are similarly located in the like area of lobe 21. The purpose and location of these passage means is to conduct pressure fluid from the hollow rotor to the cavity lobes at appropriate times to cause the desired motion of rotor 12 by pressure on a flank thereof. In the dead-center position of the crankshaft, shown in FIG. 1, working chamber 57 is at its smallest volume, and passage means 73 conducts pressure fluid past seal means 66 and 69 to lobe 21 to act on flank surface 34 of rotor 12, while passage means 72 does not reach past seal means 66 and hence does not supply pressure fluid to lobe 22 to act on flank surface 33. Other conditions are illustrated in FIGS. 3-5** and will be discussed presently below.

Further passage means 74, 75 are provided in wall 15 at locations near lobe junctions 23 and 24. The purpose of these passages is to provide egress for pressure fluid from cavity lobes 21 and 22 at appropriate times, and for this purpose, they are connected through apertures 76, 77 and conduits 80 and 81 to an exhaust connection, not shown, which may be a condenser for reducing the exhaust steam to water and returning it to the boiler. As shown in FIG. 1, working chamber 55 is in communication with passage 74, while passage 75 is isolated by seal means 66 and 69. Again, other conditions are illustrated in FIGS. 3-5.

In FIGS. 1 and 2, there are shown additional conduits 82 and 83 leading to passages 72 and 73, and connected as at 84 to inlet conduit 59 through a starting valve 85.

Figure 6:
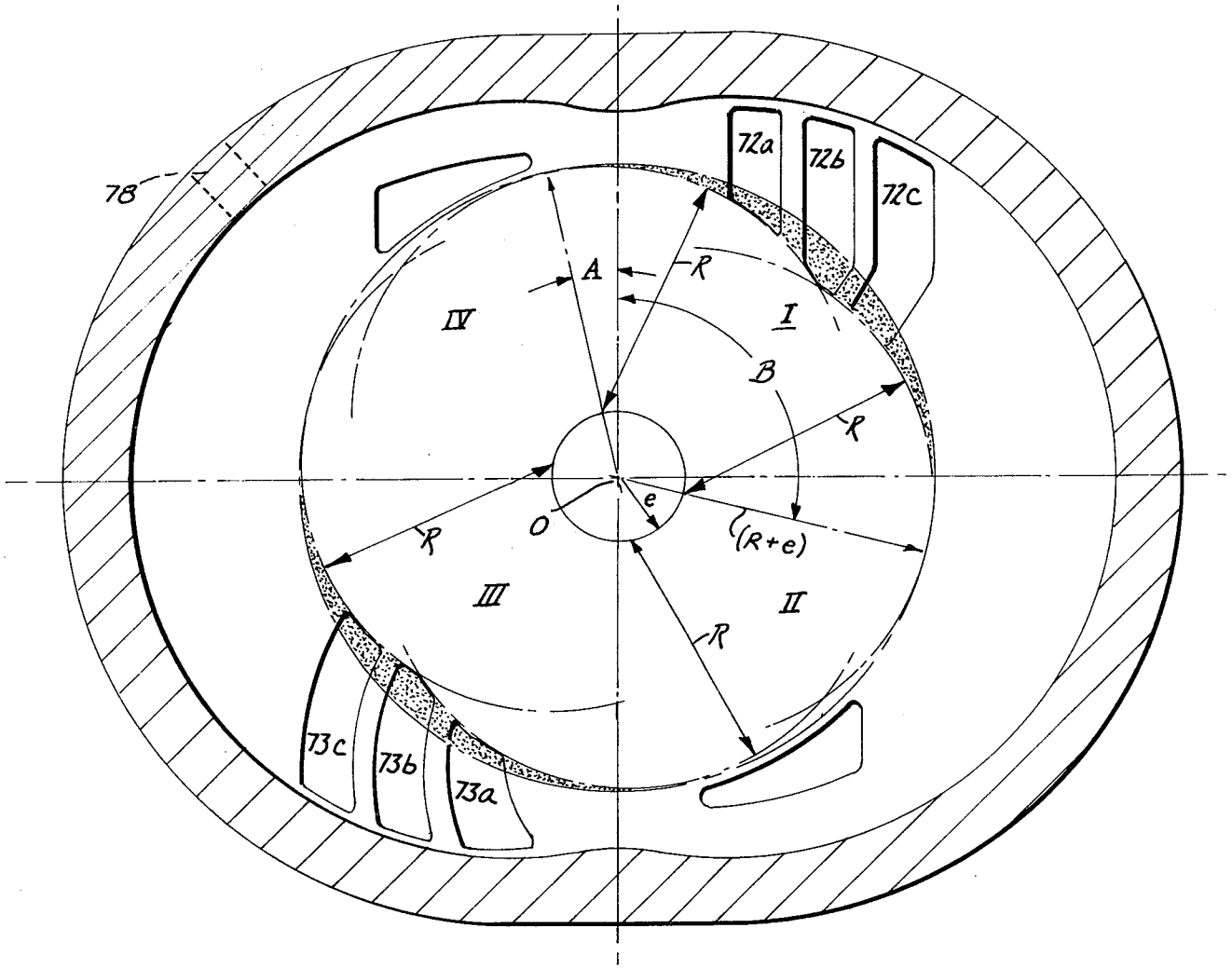
FIG. 6 is a diagram illustrating the principles determining the shapes and locations of passage means essential to the invention.

For an understanding of the principles underlying the location and shaping of passage means 72, 73, reference should now be made to FIG. 6. In this FIGURE O is the axis of rotation of the crankshaft, e is the eccentricity of the eccentric 25, and R is the inside radius of sealing ring 66. Two angles A and B are of interest, and will presently be defined. It will be realized that th circle about O of radius *e* traces the path of the center of the circular eccentric around the crankshaft axis, and the circle about O of radius $R + e$ is the outer limit of all positions of the sealing ring. Dead center of the crankshaft is a position in which eccentric 25 is nearest to a lobe juncture and is also, as has been pointed out, the position of minimum volume of a working chamber. Moreover, at this crankshaft position the moment arm of pressure acting on the rotor flank defining that working chamber is zero. Power fluid admitted to the working chamber later in the rotation of the crankshaft cannot have a negative torque effect on the rotor, and passage means 72, 73 could be designed not to admit fluid before then. However, a finite interval is required for the passage of power fluid into the chamber, and practically the fluid admission can begin a few degrees ahead of dead center, to have the minimum volume of the working chamber fully charged with power fluid by the time the rotor is in the dead-center position, without building up a significant reverse torque, particularly since the moment arm is approaching zero. A lead angle of 10° not only may be tolerable, but is desirable to insure adequate filling of the working chamber with power fluid. This is the angle A of FIG. 6.

The angle B is defined purely geometrically. It is the position of the rotor at which the volume Z of the working chamber reaches a value, compared to the maximum volume, which is the reciprocal of the expansion ratio. The latter is chosen as a matter of design, having a bearing on the efficiency of the engine and its power output. An expansion ratio of 8:1 is representative. In determining the volume it is necessary to consider not only the space between a flank of the rotor and the apposed housing wall, but also the volumes of the grooves making up passage means 72 and 73; these passages should therefore be as shallow as can be without restricting the flow of power fluid unduly. As shown in the FIGURE, a typical value for angle B is 105°.

The shaded area in FIG. 6 is defined by the circle of radius R plus *e* centered on O, and by two circles of radius R centered on the circle of radius *e* at the radii defining angles A and B respectively. Passage means 72 should terminate inwardly within this area for optimum operation of my engine. To the extent that the inner edges of the grooves lie further inward than this area, the power of the engine suffers because power fluid is then permitted to enter the working chamber prematurely, resulting in a negative torque component at the crankshaft. Outwardly the passage means must extend quite close to wall 17 to communicate with the working chambers in their minimum volume condition. The same principles apply in respect to passage means 73*a*, 73*b* and 73*c*.

I have shown three grooves in side-by-side relation. One advantage of this arrangement over a single wider groove is that it is less wearing on sealing member 66 as it sweeps over the area when support ridges are present. The actual shape of the grooves is not critical: In FIG. 6 I have shown grooves 73*a*, 73*b* and 73*c* as having a slightly different configuration from grooves 72*a*, 72*b* and 72*c*, but it is to be noted that they all terminate inwardly within the critical shaded area.

Passage means 74 are not so critical. It is only necessary that they be positioned for uncovering by sealing members 67, 68, 69 when the working chambers have reached their maximum volume and for re-covering before power fluid is next admitted to the working chambers, and that they be large enough to prevent restriction in the exhaust flow of power fluid. This function may indeed be performed by an outlet passage properly positioned in wall 17, as suggested by the dotted line passage 78 in FIG. 6. For convenience of description it may be said that inlet passages are located in the first and third quadrants, and outlet passages are located in the second and fourth quadrants.

A cycle of driven operation of my crankshaft 13 will now be traced through FIGS. 1, 3, 4 and 5. For the locations of passage means 72, 73, 74 and 75 shown, the rotation of the crankshaft in clockwise, as is the planetation of rotor 12 in cavity 20. In the position of the rotor shown in FIG. 1, working chamber 55 is free to exhaust at passage means 74, chamber 56 is closed off but filled with pressure fluid, although not yet at its maximum volume, and chamber 57 is open at passage means 73 to admit power fluid, and is at its minimum volume. The moment arm of power fluid force on flank 34 acting on crankshaft 13 through eccentric 25 is momentarily zero, but the fluid force on flank 33 has a moment arm in a direction to rotate the crankshaft clockwise, and as soon as the dead-center position is passed, the moment arm of the fluid force on flank 34 increases in the same direction, while that on flank 33 decreases.

Rotation of crankshaft results, and is accompanied by planetation of rotor 12. After 90 degrees of rotation of crankshaft 13, which accompanies 30 degrees of rotation of rotor 12 about axis 27, sealing ring 66 closes off passage means 73 from communication with chamber 57, isolating the power fluid in chamber 57 to give up its energy by expansion. After about 150 degrees rotation of the crankshaft, which accompanies 50 degrees of rotation of rotor 12 about axis 27, sealing member 67 closes off passage means 74 and sealing ring 68 opens passage means 75. FIG. 3 shows the relative position of the parts after 180° of rotation of the crankshaft, accompanied by 60° of rotation of the rotor.

FIGS. 4 and 5 show respectively the relative positions of the parts after 210° and 300° respectively of crankshaft rotation, which accompanies 70° and 100° respectively of rotation of rotor 12.

It will be appreciated that each rotation of the crankshaft by 360° is accompanied by rotor rotation of 120°, in which the cycle just described for flank 34 is repeated for flank 33 and then for flank 32. Three crankshaft cycles are needed for a single rotor cycle.

Referring again to FIGS. 3 and 2, the need for elements 82, 83 and 85 will now be apparent. If valve 85 is open momentarily, pressure fluid is admitted to the working chamber via passages 82 and 83. Although passage means 75 is open to exhaust, chamber 57 is sealed, so the fluid pressure on flank surface 34 causes rotation of the crankshaft in the desired direction. After starting is accomplished, valve 85 is closed and engine operation continues as originally described.

It will be appreciated that the power unit just described functions as the equivalent of a three-cylinder piston engine: each flank of rotor 12 is subject to two power strokes per rotation of the rotor about axis 27, which accomplishes three rotations of crankshaft 13 about axis 16.

Figure 7:
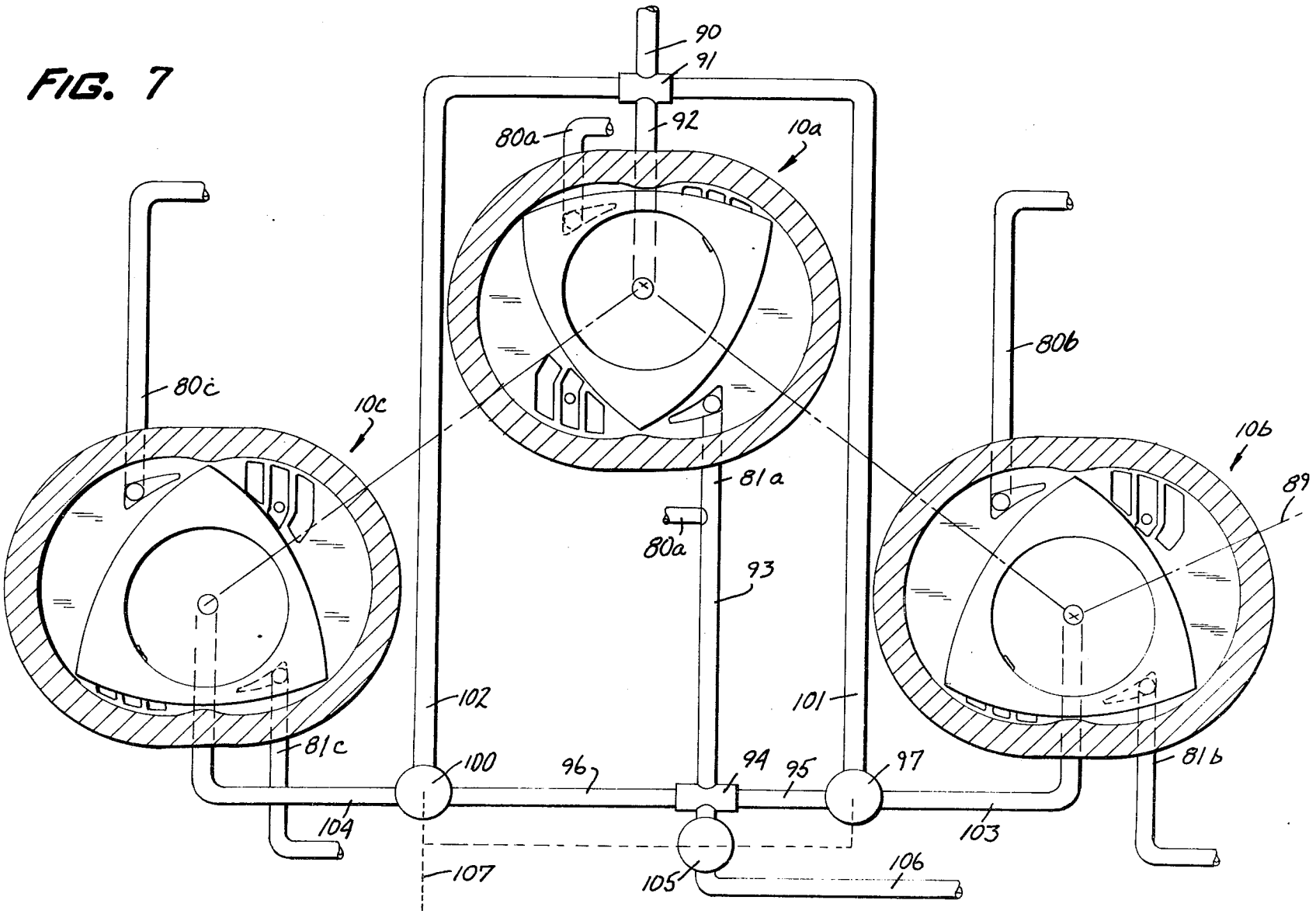
FIG. 7 shows a power system made up of a plurality of power units as disclosed in FIGS. 1-5.

The power obtainable from any engine is determined by its displacement. In piston engines, the total power available is increased not only by increasing the size of the cylinders but by increasing their number, the pistons acting about a common crankshaft, and the same principle is applicable to my power units, as is shown in FIG. 7. The efficiency of power extraction from a pressure fluid is not affected if several power units on a common crankshaft are supplied individually with the fluid, but may be considerably increased by the practice known as compounding, which comprises passing the power fluid through more than one power unit in sequence, extracting a first portion of the power from the fluid in the first unit through initial expansion of the power fluid, and extracting more power in another unit through additional expansion of power fluid, the sum effect of the successive expansions being greater than can be practically obtained in only one expansion in one unit. To accomplish this, the displacement of the later unit must be greater than that of the first unit, to allow for effective expansion of the pressure fluid exhausting from the first unit. FIG. 7 also shows how three of my power units may be compounded, the fluid exhausting from one being fed to two others.

A still further feature of my invention is also shown in FIG. 7. Consider the case of a vehicle which does most of its traveling in relatively level country, but must occasionally traverse extended relatively steep grades. An engine designed for adequate power to traverse the grades at acceptable speeds would be operating at an inefficiently low power level in the substantially flat portions of its travel. I have devised a conduit system which operates three of my power units independently or in a compound relation, depending on the positioning of a set of valves, to drive a single crankshaft. By this arrangement, the compounding configuration can be used for greater efficiency in level terrain, and all units can be directly energized to obtain greater torque when mountainous country is encountered. This is the functional equivalent, in simpler form, of having a second engine to couple in when additional torque is needed.

FIG. 7 specifically shows how three of my units may be arranged in a system for operation efficiently at a first power rating, or less efficiency at a higher power rating. Three power units 10*a*, 10*b*, and 10*c* are used, each like unit 10 described above, and their rotors are carried on a common crankshaft 89. Pressure fluid is provided to the engines in a conduit 90 to a manifold 91, which is connected by a first tap 92 to the inlet of unit 10*a*. The outlets 80*a* and 81*a* of unit 10*a* are connected by a conduit 93 to a second manifold 94, from which conduits 95 and 96 lead to a pair of valves 97 and 100. These valves are also connected by conduits 101 and 102 to manifold 91, and by conduits 103 and 104 to the inlets of units 10*b* and 10*c*. Manifold 94 is further connected through a valve 105 to a conduit 106. Conduit 106 and the outlets 80*b*, 80*c*, 81*b* and 81*c* of units 10*b* and 10*c*, are permanently connected to an exhaust or a condenser. Valves 97, 100 and 105 may be interconnected by suitable means 107 for simultaneous operation between two system configurations, as follows. In the first configuration, valve 105 is closed, valve 97 connects conduit 95 to conduit 103, and valve 100 connects conduit 96 to conduit 104. In this configuration, power fluid is supplied directly to unit 10*a*, while units 10*b* and 10*c* are energized with the power fluid exhausted from unit 10*a*. The combined volumes of units 10*b* and 10*c* are approximately half that of unit 10*a*. By the familiar process of compounding, a first portion of the energy in the pressure fluid is extracted by init 10*a*, and a second portion is extracted by units 10*b* and 10*c*.

If the occasion arises when greater power is needed and efficiency can be sacrificed, valves 97, 100 and 105 are moved to establish the second system configuration. Here pressure fluid is supplied to unit 10*a* directly as before, to unit 10*b* directly through manifold 91, conduit 101, valve 97, and conduit 103, and directly to unit 10*c* through manifold 91, conduit 102, valve 100 and conduit 104; units 10*b* and 10*c* exhaust as before, while unit 10*a* exhausts through conduit 93, manifold 94, valve 105, and conduit 106.

An additional advantage of my structure lies in the fact that it can function as an efficient compressor. Conduits 80 and 81 of FIG. 1 then comprise the inlet of the machine, and conduit 59 is the outlet: the shaft 13 must be mechanically driven in the direction opposite to that in which it runs as a motor. Check valving is desirable to prevent the compressor from being run as an air motor when not being mechanically driven.

From the foregoing, it will be evident that I have invented a new and improved rotary expansion power unit which retains the advantages of power to weight ratio and power to volume ratio which characterize rotary expansion engines, while avoiding the complications of external valving and starting mechanisms, which may operate at low or high speeds because of its continuous torque, and which is well adapted for use in a power system in which several units are energized either directly or in compound fashion to give the user an election between maximum available torque and maximum fuel economy.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a rotating machine including a housing having opposite end walls spaced apart along a first axis by a peripheral wall shaped to define an epitrochoidal cavity symmetrical about said first axis and configured as two lobes intersecting at lobe junctures which define a minor axis of the section of said housing normal to said first axis, one of said lobes lying in first and second quadrants about said first axis and the other lying in third and fourth quadrants thereabout, a rotor symmetrical about a further axis and movable in said cavity, said rotor having opposite side wall surfaces adjacent, and in slightly spaced relation, to said end walls of said housing, and interconnected by a plurality of peripheral flank surfaces which intersect at apices to determine lines of sealing contact with said peripheral wall of said housing, means, including a crankshaft on which said rotor rotates on said further axis eccentrically with respect to said first axis, for limiting motion of said rotor in said cavity to planetating movement about said first axis in the direction from said fourth quadrant to said first quadrant, so that said apices sweep through said lobes, spaced seal means, including inward valving seal means and outward chamber isolating seal means, carried by at least one side wall surface of said rotor to move in the interstice between said side wall surface and the adjacent end wall of the housing, so that said rotor and said housing jointly define a plenum space inward of said valving seal means and a plurality of distinct working chambers, outward of said isolating seal means, which move about said first axis and successively increase and decrease in volume with said movement of said rotor, and means for conducting a fluid into said housing at a site inward of said valving seal means, the improvement which comprises:

bridging passage means in the inner surface of at least one of said end walls, sized to conduct pressure fluid from said plenum space to said working chambers during first predetermined portions of said movement;

and further passage means in said inner surface of said one of said end walls for affording egress of pressure fluid from said working chambers during second predetermined portions of said movement.

2. In a rotating machine including a housing having opposite end walls spaced apart along a first axis by a peripheral wall shaped to define an epitrochoidal cavity symmetrical about said first axis and configured as two lobes intersecting at lobe junctures which define a minor axis of the section of said housing normal to said first axis, one of said lobes lying in first and second quadrants about said first axis and the other lying in third and fourth quadrants thereabout, a rotor symmetrical about a further axis and movable in said cavity, said rotor having opposite side wall surfaces adjacent, and in slightly spaced relation, to said end walls of said housing, and interconnected by a plurality of peripheral flank surfaces which intersect at apices to determine lines of sealing contact with said peripheral wall of said housing, means, including a crankshaft on which said rotor rotates on said further axis eccentrically with respect to said first axis, for limiting motion of said rotor in said cavity to planetating movement about said first axis in the direction from said fourth quadrant to said first quadrant, so that said apices sweep through said lobes, spaced seal means, including inward valving seal means and outward chamber isolating seal means, carried by at least one side wall surface of said rotor to move in the interstice between said side wall surface and the adjacent end wall of the housing, so that said rotor and said housing jointly define a plenum space inward of said valving seal means and a plurality of distinct working chambers, outward of said isolating seal means, which move about said first axis and successively increase and decrease in volume with said movement of said rotor, and means for conducting a fluid into said housing at a site inward of said valving seal means, the improvement which comprises:

bridging passage means in the inner surface of at least one of said end walls, sized to conduct pressure fluid from said plenum space to said working chambers during first predetermined portions of said movement, said bridging passage means being positioned off said minor axis in an odd numbered one of said quadrants and extending inward from near the location of said peripheral wall to a site lying inward of said valving means during said first predetermined portions of said movement;

and further passage means in said inner surface of said one of said end walls for affording egress of pressure fluid from said working chambers during second predetermined portions of said movement, said second passage means being positioned off said minor axis in an even numbered one of said quadrants to always lie outward of said valving seal means, and to be located between said seal means except during said second predetermined portions of said movement.

3. In a rotating machine including a housing having opposite end walls spaced apart along a first axis by a peripheral wall shaped to defined an epitrochoidal cavity symmetrical about said first axis and configured as two lobes intersecting at lobe junctures which define a minor axis of the section of said housing normal to said first axis, one of said lobes lying in first and second quadrants about said first axis and the other lying in third and fourth quadrants thereabout, a rotor symmetrical about a further axis and movable in said cavity, said rotor having opposite side wall surfaces adjacent, and in slightly spaced relation, to said end walls of said housing, and interconnected by a plurality of peripheral flank surfaces which intersect at apices to determine lines of sealing contact with said peripheral wall of said housing, means, including a crankshaft on which said rotor rotates on said further axis eccentrically with respect to said first axis, for limting motion of said rotor in said cavity to planetating movement about said first axis in the direction from said fourth quadrant to said first quadrant, so that said apices sweep through said lobes, spaced seal means, including inward valving seal means and outward chamber isolating seal means, carried by at least one side wall surface of said rotor move in the interstice between said side wall surface and the adjacent end wall of the housing, so that said rotor and said housing jointly define a plenum space inward of said valving seal means and a plurality of distinct working chambers, outward of said isolating seal means, which move about said first axis and successively increase and decrease in volume with said movement of said rotor, and means for conducting a fluid into said housing at a site inward of said valving seal means, the improvement which comprises:

bridging passage means in the inner surface of at least one of said end walls, sized to conduct pressure fluid between said plenum space and said working chambers during first predetermined portions of said movement, said bridging passage means being positioned off said minor axis in an odd numbered one of said quadrants and extending inward from near the location of said peripheral wall to a site lying inward of said valving seal means during said first predetermined portions of said movement;

and further passage means in said inner surface of said one of said end walls for affording egress of pressure fluid from said working chambers during second predetermined portions of said movement.

4. A structure according to claim 3 in which the valving seal means is circular at a known radius about said further axis, and the inward reach of said bridging passage means falls in the area lying inside a first circle, centered on said first axis and having a radius equal to the sum of said known radius added to the eccentricity of said further axis about said first axis, and lying outside of two further circles having said known radius and centered on the intersections, with the circle about said first axis traced by said further axis, of two radii angularly displaced about said first axis from said minor axis by two opposite angles of predetermined magnitudes.

5. A rotating machine comprising, in combination:

a housing having opposite end walls spaced apart along a first axis by a peripheral wall shaped to define an epitrochoidal cavity symmetrical about said first axis and configured as two lobes intersecting at lobe junctures which define a minor axis of the section of said housing normal to said first axis, one of said lobes lying in first and second quadrants about said first axis and the other lying in third and fourth quadrants thereabout;

a rotor symmetrical about a further axis an movable in said cavity, said rotor having opposite side wall surfaces adjacent, and in slightly spaced relation, to said end walls of said housing, and interconnected by a plurality of peripheral flank surfaces which intersect at apices to determine lines of sealing contact with said peripheral wall;

means, including a crankshaft on which said rotor rotates on said further axis eccentrically with respect to said first axis, for limiting motion of said rotor in said cavity to planetating movement about said first axis in the direction from said fourth quadrant to said first quadrant, so that said apices sweep through said lobes;

spaced seal means, including inward valving seal means and outward chamber isolating seal means, carried by the side wall surfaces of said rotor to move in the interstices between said side wall surfaces and the adjacent end walls of the housing, so that said rotor and said housing jointly define a plenum space inward of said valving means and a plurality of distinct working chambers, outward of said isolating seal means, which move about said first axis and successively increase and decrease in volume with said movement of said rotor;

means for conducting a fluid into said housing at a site inward of said valving seal means;

bridging passage means in the inner surfaces of said end walls, sized to conduct fluid from said plenum space to said working chambers during first predetermined portions of said movement, said bridging passage means being positioned off said minor axis in the odd numbered ones of said quadrants and extending inward from near the location of said peripheral wall to sites lying inward of said valving seal means during said first predetermined portions of said movement;

and further passage means in said inner surfaces of said end walls for affording fluid connection with said working chambers during second predetermined portions of said movement, said further passage means being positioned off said minor axis in the even numbered ones of said quadrants to always lie outward of said valving seal means, and to be located between said valving and isolating seal means except during said second predetermined portions of said movement.

6. A structure according to claim 5 together with means connected in driven relation to said crankshaft for taking mechanical energy of rotation therefrom.

7. A structure according to claim 5 in which said rotor is hollow and said energizing means supplies said pressure fluid through said hollow rotor.

8. A structure according to claim 5 in which the first named means comprises an eccentric revolvable about said first axis and engaging said rotor for relative rotation about said second axis, a first gear fixed in said housing concentric with said axis, and a second gear fixed to said rotor and meshing with said first gear.

9. A structure according to claim 5 in which said seal means extends around a side wall surface of said rotor with said inlet valving seal means nearer said second axis that said working chamber seal means, said first passage means always extending outwardly past said working chamber seal means, but extending inwardly past said inlet valving seal means during said first predetermined portions of said movement.

10. A structure according to claim 5 in which said seal means extends around a side wall surface of said rotor with said inlet valving seal means inwardly nearer said second axis than said working chamber seal means, said first passage means always extending outwardly past said working chamber seal means during said second predetermined portions of said movement.

11. A structure according to claim 5 including means momentarily operable to supply said pressure fluid directly to at least one of the working chambers of said cavity.

* * * * *

UNITED STATES PATENT AND TRADEMARK OFFICE

CERTIFICATE OF CORRECTION

PATENT NO. : 4,047,856

DATED : September 13, 1977

INVENTOR(S) : Ralph M. Hoffmann

It is certified that error appears in the above-identified patent and that said Letters Patent are hereby corrected as shown below:

Column 4, line 20, "th" should be --the--.

Line 55 ";" should be --:--

Column 5, line 44, "dead-center" should be --"dead-center"--.

Column 7, line 26, ";" should be --:--.

Column 12, line 7, "that" should be --than--.

Signed and Sealed this

Ninth Day of May 1978

[SEAL]

Attest:

RUTH C. MASON
Attesting Officer

LUTRELLE F. PARKER
Acting Commissioner of Patents and Trademarks

UNITED STATES PATENT AND TRADEMARK OFFICE

CERTIFICATE OF CORRECTION

PATENT NO. : 4,047,856

DATED : September 13, 1977

INVENTOR(S) : Ralph M. Hoffmann

It is certified that error appears in the above-identified patent and that said Letters Patent are hereby corrected as shown below:

Column 9, line 16, after "valving" insert --seal--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*